United States Patent [19]

Dahlgren

[11] 3,986,452

[45] *Oct. 19, 1976

[54] LIQUID APPLICATOR FOR LITHOGRAPHIC SYSTEMS

[75] Inventor: Harold P. Dahlgren, Dallas, Tex.

[73] Assignee: Dahlgren Manufacturing Company, Inc., Dallas, Tex.

[ * ] Notice: The portion of the term of this patent subsequent to July 5, 1983, has been disclaimed.

[22] Filed: Aug. 14, 1972

[21] Appl. No.: 280,357

Related U.S. Application Data

[63] Continuation-in-part of Ser. No. 600,650, Dec. 9, 1966, Pat. No. 3,705,451, which is a continuation-in-part of Ser. No. 414,574, Nov. 30, 1964, abandoned, which is a continuation-in-part of Ser. No. 26,035, May 2, 1960, Pat. No. 3,168,037, which is a continuation-in-part of Ser. No. 844,372, Oct. 5, 1959, abandoned.

[52] U.S. Cl. ..... 101/148

[51] Int. Cl.[2] ..... B41F 7/24

[58] Field of Search ..... 101/148, 147, 349, 350, 101/351, 206–209

[56] References Cited

UNITED STATES PATENTS

| | | | |
|---|---|---|---|
| 3,026,795 | 3/1962 | Dietrich | 101/148 |
| 3,168,037 | 2/1965 | Dahlgren | 101/148 |
| 3,259,062 | 7/1966 | Dahlgren | 101/148 |
| 3,283,707 | 11/1966 | Greuber et al. | 101/148 |
| 3,283,712 | 11/1966 | Chambon | 101/350 |
| 3,343,484 | 9/1967 | Dahlgren | 101/148 |
| 3,433,155 | 3/1969 | Norton | 101/148 |
| 3,504,626 | 4/1970 | Worthington | 101/350 |
| 3,508,489 | 4/1970 | Norton | 101/148 |
| 3,587,460 | 6/1971 | Chambon | 101/148 |
| 3,647,525 | 3/1972 | Dahlgren | 101/148 |
| 3,688,694 | 9/1972 | Preuss | 101/148 |

FOREIGN PATENTS OR APPLICATIONS

| | | | |
|---|---|---|---|
| 870,687 | 6/1961 | United Kingdom | 101/148 |

*Primary Examiner*—J. Reed Fisher
*Attorney, Agent, or Firm*—Howard E. Moore; Gerald G. Crutsinger

[57] ABSTRACT

A method and apparatus for applying a controlled quantity of dampening fluid to a lithographic printing system comprising a smoothly finished hydrophilic transfer roller mounted in pressure indented relation with a metering roller having a smooth resilient surface. Pressure between the metering roller and transfer roller is adjustable and the respective rollers are driven by independent variable speed drive means such that surface speeds of the rollers relative to each other and relative to surfaces of the lithographic printing system are precisely controllable.

3 Claims, 3 Drawing Figures

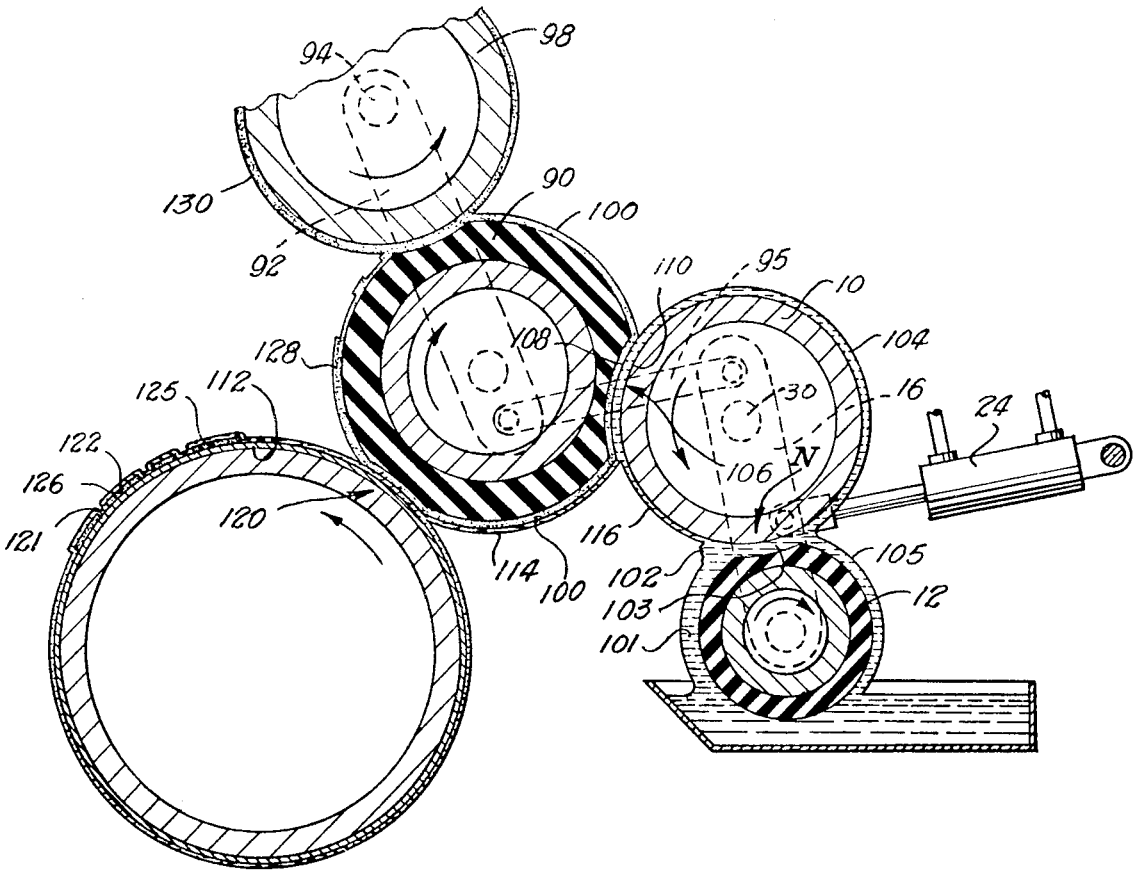
Fig. II
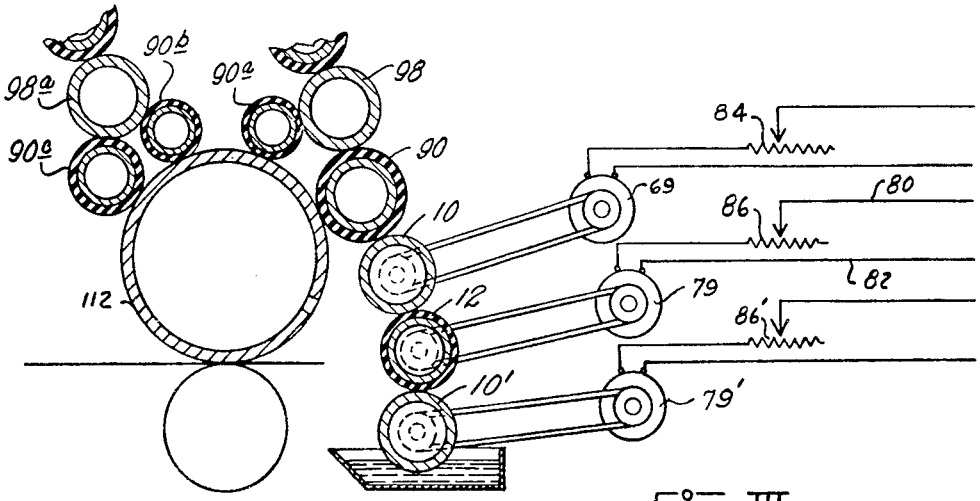
Fig. III

LIQUID APPLICATOR FOR LITHOGRAPHIC SYSTEMS

CROSS REFERENCE TO RELATED APPLICATIONS

This application is a continuation-in-part of U.S. Pat. application Ser. No. 600,650 filed Dec. 9, 1966 entitled "Dampening Transfer and Material Conditioning Roller and Method of Preparing Same", (now U.S. Pat. No. 3,705,451) which was a continuation-in-part of Ser. No. 414,574 filed Nov. 30, 1964 (abandoned) which was a continuation-in-part of Ser. No. 26,035, filed May 2, 1960 (now U.S. Pat. No. 3,168,037) entitled "Means for Dampening Lithographic Offset Printing Plates", which was a continuation-in-part of Ser. No. 844,372 filed Oct. 5, 1959, now abandoned.

BACKGROUND OF INVENTION

Dampening systems of the type disclosedd in U.S. Pat. No. 3,168,037 and U.S. Pat. No. 3,343,484 to Harold P. Dahlgren have offered significant improvements over dampening systems previously employed.

Such systems have included two rollers disposed in pressure indented relation, one of the rollers having a relatively hard hydrophillic surface and the other roller having a smooth resilient surface. In the preferred embodiment illustrated in the drawings of the aforementioned patents the transfer and metering rollers were geared together to travel at substantially equal surface speeds and were driven by a variable speed drive means for metering a film of dampening fluid through a nip between the rollers and for transferring the film of dampening fluid to the lithographic printing system.

The thickness of the film of dampening fluid delivered to the surface of the transfer roller moving out of the nip between the metering roller and transfer roller was controlled primarily by adjustment of pressure between adjacent surfaces of the metering and transfer rollers.

The rate at which the metered film of dampening fluid, carried on the surface of the transfer roller, was delivered to the lithographic printing system was controlled by the variable speed drive means. Briefly stated, the theory of operation was that given a film of predetermined thickness the quantity of dampening fluid delivered was directly related to the speed of the film. In other words, to reduce the rate at which dampening fluid was delivered to the lithographic system, the transfer roller speed could be reduced; and, to increase the quantity of dampening fluid, the speed of the transfer roller could be increased. However, such results follow only so long as the speed differential between the transfer roller and the ink coated form roller was not excessive.

Excessive slippage resulted in application of hydraulic forces in the nip between the transfer roller and the applicator roller which caused excessive emulsification of the distinct films of ink and dampening fluid. Excessive emulsification of ink and dampening fluid at the nip between the transfer roller and form roller resulted in transfer of the emulsion by the surface of the transfer roller to the surface of the resilient metering roller which was not hydrophillic. Build-up of ink on the surface of the metering roller resulted in streaking of printed sheets because of non-uniform surface characteristics of the metering roller which caused a non-uniform film of dampening fluid to be metered onto the surface of the transfer roller.

To accommodate existing press design, metering and transfer rollers have been constructed of diameters generally in a range of approximately 3 to 6 inches. At surface speeds of about 300 feet per minute films of dampening fluid tended to separate from the surface of the metering roller as a result of centrifugal force. When the metering roller, geared to the transfer roller, was slowed to prevent splashing and slinging of dampening fluid, excessive slippage resulted at the nip between the transfer roller and the form roller which carried the dampening fluid to the lithographic printing system.

In applications where the metering roll was driven by the hydrophillic transfer roller and where a relatively fast hydrophillic transfer roller surface speed was required for printing, such as in a web press, the metering roller slung water to such an extend that experiments were conducted on apparatus wherein the transfer roller and metering roller were geared together to run at a speed ratio of 2:1 thereby substantially reducing the surface speed of the metering roller which carried a thick film of dampening fluid. Slinging of dampening fluid was then stopped but the film of dampening fluid delivered by the transfer roller was of a thickness which required excessive slippage, resulting in excessive emulsification, between the hydrophillic transfer roller and the form roller.

Tests were conducted on a printing press having an ink coated form roller running at a surface speed of 1,000 feet per minute. The hydrophillic transfer roller and the resilient metering roller of the liquid applicator system were geared together at a speed ratio of 5:3. The liquid applicator system could not be adjusted to provide acceptable results because as the surface speed of the transfer roller was increased to prevent excessive slippage between adjacent surfaces of the transfer roller and the applicator roller too much water was delivered to the lithographic system. Increasing pressure at the nip between the metering roller and the transfer roller did not effectively reduce the thickness of the film of dampening fluid, carried by the transfer roller, to the required thickness.

A further test was conducted on the same printing press when the surface speed of the form roller was 1,000 feet per minute. However, the hydrophillic transfer roller and the resilient metering roller were driven by separate variable speed drive motors such that the transfer roller was run at a surface speed of 500 feet per minute and the metering roller was run at speeds of less than 50 feet per minute. Extremely high quality printing was produced.

In laboratory experiments the film thickness carried by the surface of the hydrophillic transfer roller was measured. The transfer and metering rollers were geared together at a 1:1 speed ratio and pressure between the rollers was maintained at a constant level. As surface speeds of the transfer and metering rollers were continuously increased the thickness of the film carried on the surface of the transfer roller did not continuously increase. A graph of the film thickness relative to surface speed of the metering and transfer rollers produced a curve of somewhat sinusoidal nature.

The same test was conducted with the transfer and metering rollers being geared together at a speed ratio of 2:1. Again the film thickness was somewhat sinusoidal in nature as surface speeds of the rollers were increased. Thus, transfer and metering rollers geared together at a fixed speed ratio do not deliver a uniformly increasing quantity of dampening fluid to a lithographic printing system as surface speeds of the rollers are increased over a wide range of speeds. As the surface speeds of the rollers is increased the quantity of dampening fluid increases to a point after which further increase in the surface speed of the rollers results in reduction in the quantity of dampening fluid delivered.

From the foregoing it is concluded that provision of separate variable speed drive means for independently controlling surface speeds of metering and transfer rollers of the systems of the type disclosed in the aforementioned Dahlgren patents permits metering of thinner films in precisely controlled quantities onto the surface of the transfer roller and permits adjustment of the surface speed of the transfer roller relative to the surface speed of an applicator roller to produce desired hydraulic forces in the nip between the transfer roller and the applicator roller to prevent excessive emulsification of dampening fluid and ink while delivering proper amounts of dampening fluid to the lithographic printing system.

SUMMARY OF INVENTION

I have developed an improved liquid applicator for lithographic systems comprising a transfer roller having a hard smooth hydrophillic surface disposed in pressure indented relation with a metering roller having a smooth resilient surface wherein the transfer roller and metering roller are independently driven by variable speed drive means permitting independent precision control of surface speeds of each of the rollers.

The metering roller is preferably rotated such that the surface speed thereof will carry an abundant supply of dampening fluid to the nip between the transfer roller and the metering roller. The transfer roller is rotated such that the surface speed thereof is substantially greater than the surface speed of the metering roller for transferring a relatively thin film of dampening fluid to the surface of a form roller of a lithographic system.

The transfer roller preferably rotates such that the surface speed thereof is different from that of the form roller and adjusted such that a portion of the film of dampening fluid on the transfer roller will be applied to the surface of the form roller while sufficient dampening fluid remains upon the surface of the transfer roller moving away from contact with the form roller to maintain a continuous film of dampening fluid thereon for maintaining ink rejecting properties of the hydrophillic surface.

Pressure between the metering roller and the transfer roller is adjustable and pressure along the length thereof is controlled by skewing apparatus adapted to move an end of one of the rollers circumferentially about the axis of the other roller to spirally twist the resilient surface of the resilient roller about the harder surface of the other roller.

A primary object of the invention is to provide a liquid applicator for lithographic systems particularly adapted for continuously supplying a precisely regulated quantity of dampening fluid to a lithographic system at a precisely controlled rate.

Another object of the invention is to provide a liquid applicator for lithographic printing systems adapted to precisely control hydraulic force at a nip between adjacent rollers for splitting a metered film carried by one of the rollers to cause a film to be transferred to the other roller.

Another object is to provide a liquid applicator for lithographic printing systems which is particularly adapted to reduce the tendency of dampening fluid and ink to become emulsified and fed into the dampening fluid metering apparatus.

A further object is to provide a liquid applicator for lithographic printing systems adapted to prevent transfer of ink to a nip between transfer and metering roller positioned in pressure indented relation for metering a film of dampening fluid.

A further object is to provide a liquid applicator adapted to meter a uniform film of dampening fluid onto a lithographic printing plate moving at speeds in excess of 1,000 feet per minute.

Another object of the invention is to provide a liquid applicator for lithographic systems particularly adapted for use on high speed web presses wherein surface speeds of rollers of the apparatus are independently controllable to deliver metered quantities of dampening fluid to a lithographic system wherein rollers of the liquid applicator are not rotated at a speed which would result in centrifugal force, tending to separate the film from the surface, exceeding the force of molecular attraction, tending to resist separation of the film of dampening fluid from the surface of the roller.

Another object of the invention is to provide a liquid applicator system for printing presses wherein a transfer roller and metering roller are mounted for adjustment in longitudinal and axial relationship to provide for exact and desired pressure therebetween along the entire lengths thereof and to provide proper distribution and thickness of dampening fluid throughout the lengths of the rollers.

These and other objects are effected by my invention as will be apparent in the following description taken in conjunction with the accompanying drawings.

DESCRIPTION OF THE DRAWINGS

Drawings of two embodiments of the invention are annexed hereto so that the invention may be better and more fully understood, in which;

FIG. I is a diagrammatic perspective view of the liquid applicator system;

Figure 1:
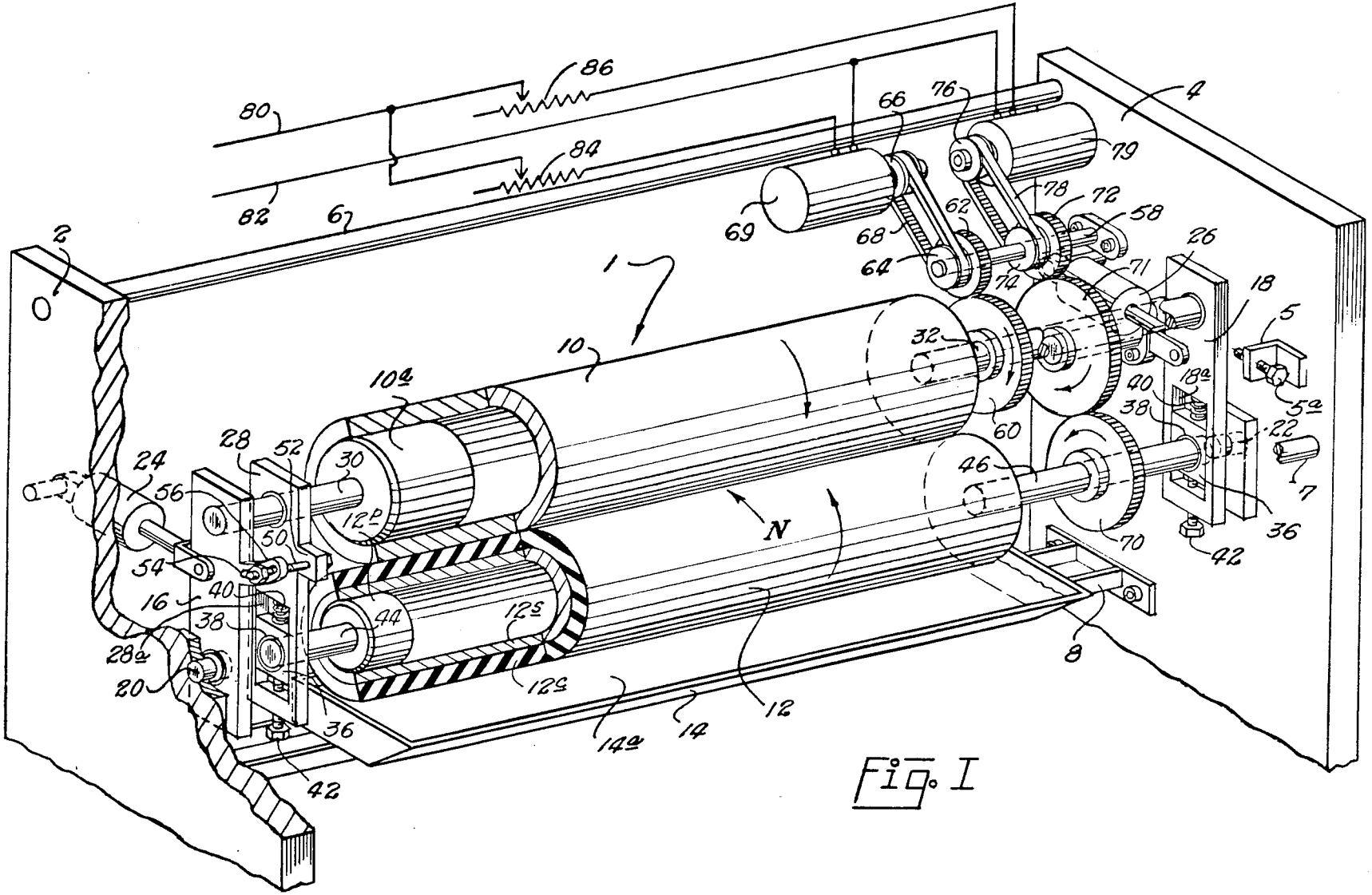

FIG. II is an enlarged diagrammatic view illustrating the relative positions of the source of dampening fluid, a metering roller, a transfer roller and a form roller in a lithographic printing system;

FIG. III is a diagrammatic view similar to FIG. II of a modified form of the liquid applicator system illustrating roller means arranged to meter a film of dampening fluid onto the surface of the metering roller.

Numeral references are employed to designate like parts throughout the various figures of the drawings.

DESCRIPTION OF A PREFERRED EMBODIMENT

In FIG. I of the drawing the numeral 1 generally designates a liquid applicator system adapted for use in conjunction with inker apparatus for applying dampening fluid and ink to a lithographic printing plate of a printing press.

Liquid applicator 1 comprises spaced side frames 2 and 4 joined by tie bars 6, 7 and 8 forming a strong rigid structure for supporting transfer roller 10, metering roller 12 and dampening fluid pan 14.

Throw-off links 16 and 18 are pivotally secured by stub shafts 20 and 22 to the respective side frames 2 and 4. Throw-off cylinders 24 and 26 are pivotally connected between side frames 2 and 4 and throw-off links 16 and 18, respectively, for pivoting throw-off links 16 and 18 about stub shafts 20 and 22 for moving transfer cylinder 10 into position, as will be hereinafter more fully explained, for delivering dampening fluid to a lithographic printing system.

A skew arm 28 is mounted for pivotal movement about the axis of transfer roller 10. As diagrammatically illustrated in FIG. I skew arm 28 is rotatably secured to stub shaft 30 extending outwardly from the end of transfer roller 10.

Skew arm 28 and throw-off link 18 have passages 28*a* and 18*a* respectively, formed in lower ends thereof in which blocks 36 carrying self-aligning bearings 38 are slidably disposed. Suitable means such as resilient springs 40 urge blocks 36 longitudinally of skew arm 28 and throw-off link 18 in a direction away from the longitudinal axis of transfer roller 10. A pressure adjustment screw 42 urges block 36 longitudinally of skew arm 28 and throw-off link 18 against the bias of springs 40. Stub shafts 44 and 46, extending outwardly from opposite ends of metering roller 12, are received in self-aligning bearings 38 to rotatably secure metering roller 12 in pressure indented relation with transfer roller 10.

It should be readily apparent that rotation of pressure adjustment screws 42 will move opposite ends of metering roller 12 relative to the axis of transfer roller 10 for controlling pressure between transfer roller 10 and metering roller 12.

Suitable means is provided for establishing and maintaining a desired angular relationship between throw-off link 16 and skew arm 28. In the form of the invention illustrated in the drawing a lock bolt 50 extends through an aperture in lug 52 on skew arm 28 and is received in an arcuate slot 54, having a center of curvature coincident with the axis of transfer roller 10, formed in a lug 56 on throw-off link 16.

It should be readily apparent that bolt 50 can be loosened permitting rotation of skew arm 28 about the axis of transfer roller 10 and tightened to maintain a desired angular relationship between throw-off link 16 and skew arm 28.

Side frames 2 and 4 have suitable adjustable stop means such as angle members 5 having set screws 5*a* extending therethrough for engaging throw-off links 16 and 18 when rods of throw-off cylinders 24 and 26 are extended for establishing a desired pressure relationship between the transfer cylinder 10 and an ink coated form roller arranged to transfer dampening fluid to a lithographic printing plate as will be hereinafter more fully explained.

Shaft 32 extending outwardly from the end of transfer roller 10 has a gear 60 secured in meshing relation with a gear 62 rotatably disposed on shaft 58 secured to side frame 4.

Gear 62 is secured to a pulley 64 driven by a pulley 66 through a timing belt 68. Pulley 66 is secured to the shaft of variable speed drive means such as electric motor 69.

Shaft 46, extending outwardly from the end of metering roller 12, has a gear 70 secured thereto in meshing relation with an idler gear 71. Idler gear 71 is driven by a gear 72 rotatably secured to shaft 58.

Gear 72 is secured to pulley 74 which is driven by a pulley 76 through a timing belt 78. Pulley 76 is secured to the shaft of variable speed drive means such as electric motor 79.

Power supply lines 80 and 82 are connected through variable rheostats 84 and 86 to terminals of motors 69 and 79, respectively, so that motors may be run at variable speeds to independently control the speed of rotation and consequently, surface speeds of transfer roller 10 and metering roller 12.

Suitable means is provided for delivering an abundant supply of dampening fluid to the nip N between adjacent surfaces of transfer roller 10 and metering roller 12.

In the particular embodiment of the invention illustrated in FIG. I a portion of the surface of metering roller 12 is submerged in dampening fluid 14*a* in dampening fluid pan 14.

The dampening fluid may be moistening fluid such as water with other ingredients added thereto, such as material to lower the surface tension of the water for reducing the tendency of the water to form globules on the surface of ink which would prevent uniform distribution of a film of dampening fluid over a film of ink.

Dampening fluid 14*a* preferably comprises a mixture of water and water soluble, volatile organic liquid such as alcohol, esters, ketones, and similar compounds which are compatible with, and receptive to, oil-based ink. Commercial grade alcohol is preferably employed because of its economy and ready availability. Such material is molecularly compatible with ink because the vehicle of the ink is organic material and the dampening fluid containing alcohol is organic material.

Preferably a watery, highly volatile alcohol such as ethyl alcohol, methyl alcohol or isopropyl is used.

It has been found that mixing 10 to 25% alcohol with water works satisfactorily for most printing operations. Dampening fluid containing alcohol is quickly absorbed in the inking system because it is ink compatible and rides on the surface of ink coated form rollers in a uniformly thin layer and evaporates quickly. Upon evaporation alcohol does not cause oxidization as does water and provides a cooling agent for the rollers running in contact.

The transfer roller 10 is preferably metal and has an exterior surface which is highly machined and polished and treated so as to render same moisture receptive or hydrophillic. Preferably the surface of roller 10 is chrome plated, and is polished and treated after chrome plating, so as to render it hydrophillic, and at the same time make the surface perfectly smooth insofar as possible so that no irregularities or coarse areas thereof present a surface for the depositing of ink thereon by reason of the puncturing or breaking of the film or membrane of dampening fluid deposited thereon, as it rotates under pressure with a form roller, as will be hereinafter more fully explained. Peaks of irregularities, or coarse surface areas, puncturing and extending through a dampening fluid membrane, would contact ink on the surface of the form roller, causing transfer of ink back to the dampening system. The surface of roller 10 should be ground and polished to provide a surface smooth finish within a range of 0.5 to 500 RMS micro-inch. Best results have been obtained with a finish of 5 micro-inch.

It has been found that a chrome surface is readily susceptible to the formation of chrome oxide thereon when exposed to air during normal manufacturing processes, which prevents the surface from being water receptive or hydrophillic. Such chrome oxide also provides a hydrophobic or chemically greasy surface, which would provide an attraction for ink. The treatment hereinafter described is for the purpose of removing chrome oxide from the surface of the transfer roller 14 and preventing same from reforming thereon after such treatment.

One method of treatment comprises bathing the chromium surface with a solution of one part hydrochloric or sulfuric acid, one part gum arabic water solution, 14° Baume, and one part water. The acid dissolves and removes the chromium oxide, and the gum arabic coats the surface of the chrome to prevent further oxidization. The period of time which the chromium surface must be exposed to this mixture depends upon the time between the chromium plating and machine processing of the surface, and the treatment. The longer the surface is exposed to the air the greater will be the accumulation of chromium oxide. It has been found that the surface of the roller 10 so treated will pick up a uniform film of moisture from the nip N between transfer roller 10 and metering roller 12 and such film of dampening fluid on roller 10 is rotated to contact the surface of the ink coating on the surface of form roller 90.

Transfer cylinder 10 preferably comprises a hollow tubular sleeve having plugs 10*a* in the ends thereof on which stub shafts 30 and 32 are formed. As hereinbefore explained, stub shaft 30 extends through bearings in skew arm 28 and throw-off link 16 and stub shaft 32 is rotatably journaled in a bearing in the upper end of throw-off link 18.

Metering roller 12 preferably comprises a hollow tubular sleeve 12*s* having plugs 12*p* extending into opposite ends thereof. Plugs 12*p* have stub shafts 44 and 46 formed thereon.

A resilient cover 12*c* is secured about the outer surface of sleeve 12*s*. The preferred process for forming resilient cover 12*c* is described in U.S. Pat. No. 3,514,312 to provide a roller comprising the metal substrate 12*s* having an adhesive bonded to it, a layer of relatively hard plastic bonded to the adhesive, and a layer of softer plastic fused to and co-mingled with the intermediate layer of harder plastic.

To reduce the tendency of dampending fluid to accumulate adjacent the ends of transfer roller 10 metering roller 12 is longer than transfer roller 10 such that ends of the metering roller 12 extend beyond the ends of transfer roller 10. The transfer roller 10 is preferably longer than form roller 90 to minimize accumulation of excess dampening fluid adjacent ends of form roller 90.

A modified form of the apparatus for metering dampening fluid is illustrated in FIG. III.

In the apparatus illustrated in FIG. III the means for delivering an excess of dampening fluid to the nip N between transfer roller 10 and metering roller 12 comprises a pan roller 10′ having a portion of the surface thereof moving through dampening fluid 14*a* in pan 14 and being disposed in pressure indented relation with metering roller 12. Pan roller 10′ preferably has a hydrophillic surface thereon, that is, dampening fluid receptive and ink rejecting, prepared as hereinbefore described in the description of transfer roller 10.

In some applications small quantities of ink might become mixed with dampening fluid 14*a* in pan 14. Roller 10′ having a surface which is ink rejecting prevents transfer of ink floating on the surface of dampening fluid 14*a* in pan 14 to the surface of the metering roller 12 and also pre-meters a film of dampening fluid onto the surface of the metering roller 12.

Pan roller 10′ is preferably driven by a variable speed drive motor 79′. Providing metering in a sequence of steps at nips N′ and N allows adjustment of pressure at the respective nips to render the metering apparatus less responsive to changes in roller speed for allowing a substantial change in relative speeds of the various rollers while making only slight changes in the thickness of the respective metered films.

Referring to FIG. II of the drawing, transfer roller 10 is preferably positioned in pressure indented relation with a form roller 90 having a metal tubular core 91, to the ends of which are secured stub shafts extending outwardly therefrom and rotatably journaled in bearings carried by links 92 pivotable about a shaft 93 rotatably secured to the side frames of a printing press and carrying an inker vibrator roller 94.

A connector 95 is pivotally secured to the links 92 and throw-off links 16 and 18 and is positioned such that the surface of roller 90 is separated from the surface of the printing plate 112 and from the surface of transfer roller 10 when the dampener is thrown off.

Roller 90 has a smooth resilient outer cover 96 which is preferably non-absorbent.

Roller 94 is preferably a vibrator roller of conventional design and is adapted to apply a film of ink 100 to surfaces of form rollers 90 and 90*a*.

The operation and function of the apparatus hereinbefore described is as follows:

Pressure between ends of transfer roller 10 and metering roller 12 is adjusted by rotating pressure adjustment screws 42.

Since long rollers urged together in pressure relation tend to deflect or bend, pressure adjacent centers of such rollers is less than pressure adjacent ends thereof. Pressure longitudinally of rollers 10 and 12 is adjusted by loosening bolt 50 and rotating skew arm 28 about the axis of transfer roller 10 to a position wherein a desired pressure distribution longitudinally of rollers 10 and 12 is obtained.

Adjustment screw 5 is positioned to engage throw-off links 16 and 18 for establishing a desired pressure between transfer roller 10 and form roller 90.

The surface speeds of rollers 10 and 12 are independently regulatable by manipulating rheostats 84 and 86 as has been hereinbefore explained.

For the purpose of graphically illustrating the novel function and results of the process of the mechanism hereinbefore illustrated and described, an enlarged, exaggerated, diagrammatic view of the metering roller 12, the transfer roller 10 and the form roller 90 is shown in FIG. II.

As shown in such exaggerated illustration, metering roller 12, which is preferably a resilient surfaced roller having a smooth surface 12*c* thereon, has the lower side thereof immersed in dampening fluid 14*a* in pan 14. The roller 12 is in rotative contact with transfer roller 10, and the pressure therebetween is adjusted as hereinbefore described, so that the surface of transfer roller 10 is actually impressed into the surface of roller 12 as indicated at nip N.

As roller 12 rotates toward the nip N between rollers 10 and 12, a relatively heavy layer of dampening fluid, indicated at 101, is picked up and lifted on the surface of roller 12, and at the point of tangency, a cusp area at the nip N, between the rollers 10 and 12, a bead 102 of dampening fluid is piled up, the greatness of which is regulated by virtue of the fact that excess dampening fluid will fall back into the pan 14 by gravity, thus virtually creating a waterfall. The bead 102 becomes a reservoir from which dampening fluid is drawn by transfer roller 10. As rollers 10 and 12 rotate in pressure indented relation, a relatively thin layer of dampening fluid is metered between adjacent surfaces of the two rollers, as indicated at 103. Since the transfer roller 10 is treated to provide a smooth, hydrophillic surface thereon, a portion of the film 103 adheres to the surface of roller 10 as indicated at 104, the remaining portion 105 thereof being rotated back to fluid 14*a* in the pan 14. The film of dampening fluid 104 is evenly distributed on the surface of roller 10 by reason of the rotating, squeezing action between rollers 10 and 12 at their tangent point at nip N.

The film of dampening fluid 104 rides on the surface of roller 10 and comes in contact with the film 100 of viscous ink on form roller 90 at the tangent point between said rollers, as indicated at 106.

At tangent point 106 it will be observed that transfer roller 10 is impressed into the resilient surface of form roller 90 and that the film of dampening fluid 104 has an outer face 108, contacting ink film 100, and an inner face 110 adhering to the surface of roller 10 and actually separates the surface of transfer roller 10 from the film of ink 100 on form roller 90, so that there is in fact a hydraulic connection between rollers 10 and 90 as they rotate in close relationship, but there is no physical contact therebetween. The film of ink 100 is actually separated from the smooth surface of roller 10 by the film of dampening fluid 104.

It is an important fact to note that the film of dampening fluid 104 permits rollers 10 and 90 to be rotated at different surface speeds as will be hereinafter explained. Preferably, the form roller 90, which is normally rotated at the same surface speed as the lithographic printing plate 112, is rotated at a greater surface speed than the surface speed of roller 10, however, it will be understood that transfer roller 10 could be rotated at a greater surface speed than applicator roller 90 and accomplish the same functions and result as hereinafter related. By regulating the differential surface speed between transfer roller 10 and applicator roller 90 the amount of dampening fluid applied to the plate 112 may be regulated.

Within limits, as will be hereinafter more fully explained, if the surface speed of transfer roller 10 is increased the dampening fluid film 104 is presented at the tangent point 106 at a faster rate and more dampening fluid is transferred on the surface of ink film 100 to lithographic printing plate 112, and the opposite is true, if the surface speed of roller 10 is decreased. However, for a given pressure adjustment, if rollers 10 and 12 were geared together to provide a fixed differential speed relationship, limits are reached wherein further increase in surface speed of roller 10 would result in reduction in the thickness of the film 104 and consequently a reduction in the quantity of dampening fluid delivered to plate 112.

The film of dampening fluid 104, existent between adjacent surfaces of rollers 10 and 90, permits rollers 10 and 90 to be rotated at different surface speeds in sliding relationship, because the film of dampening fluid 104 actually constitutes a lubricant which permits slippage between adjacent surfaces of rollers 10 and 90 without frictional deterioration. By reason of the slippage between rollers 10 and 90, the dampening fluid film 104 is calendared, smoothed out, metered and distributed between adjacent surfaces of roller 10 and the ink film 100 on form roller 90, and the thickness and amount thereof is actually regulated by such means.

While some slippage between adjacent surfaces of transfer roller 10 and form roller 90 is desirable and contributes to effective operation of the apparatus, excessive slippage is detrimental. Transfer roller 10 preferably is driven at a surface speed which is within a range of for example, 500 feet per minute slower or faster than the surface speed of form roller 90. For example, if a printing press has paper travelling therethrough at a surface speed of 1200 feet per minute the surface of the printing plate 112 and surfaces of form roller 90 will ordinarily have surface speeds of 1200 feet per minute. The surface speed of transfer roller 10 would preferably rotate at a surface speed in a range between 700 feet per minute and 1700 feet per minute.

Excessive slippage between adjacent surfaces of transfer roller 10 and form roller 90 increases hydraulic forces acting upon ink film 100 and dampening fluid 104 which is believed to result in emulsification of the ink and dampening fluid in the nip 106 resulting in transfer of ink to the nip N between transfer roller 10 and metering roller 12, which has a surface which is receptive to ink even in the presence of dampening fluid. Slippage between transfer roller 10 and metering roller 12 in the presence of ink causes the ink to be calendared into microscopic pores forming streaks on the metering roller surface. This causes irregularities in film 104 carried by transfer roller 10.

The allowable differential in surface speeds of transfer roller 10 and form roller 90 is dependent upon a number of conditions including the degree of attraction of the specific ink for dampening fluid, the thickness of the film of dampening fluid 104 carried by transfer roller 10 and atmospheric conditions including relative humidity and temperature.

Provided the differential speed between surfaces of transfer rollers 10 and form roller 90 does not exceed permissible limits under given operating conditions, the film 104 of dampening fluid will split as rollers 10 and 90 rotate away from a tangent point therebetween in nip 106. A film of dampening fluid 114 adheres to the surface of the film 100 of more viscous ink carried by form roller 90 and a film 116 of dampening fluid adheres to the surface of the transfer roller 10 from whence it is conveyed back to the bead 102 of dampening fluid adjacent nip N.

It has already been explained that the dampening fluid film 104 is smoothed out, distributed, metered, and regulated between the tangent points of rollers 10 and 90. The interface tension between the outer surface 108 of the less viscous dampening fluid film 104, by reason of molecular attraction between the face of the more viscous ink film 100, causes the smoothened and regulated film 104 to cling to the surface of ink 100, which in turn is transferred to the plate at the tangent point between the plate 112 and form roller 90, as indicated at 120.

The lithographic printing plate 112 has hydrophillic, or water liking, non-image areas 121 and oleophillic, or ink receptive, image areas 122 formed on the surface thereof.

At the nip 120 between applicator roller 90 and printing plate 112, the ink film 100 is split, forming films 125 of ink over oleophillic surfaces 122 on the printing plate. The layer 114 of dampening fluid carried on film 100 of ink is distributed to form a thin film 126 of dampening fluid over hydrophillic areas 121 of the printing plate and over ink 125 thereon.

No appreciable amount of dampening fluid remains on the surface of form roller 90 which is moving away from the nip 120, but such dampening fluid as does remain thereon is transferred on the ink film 128 to the ink film 130 on the ink vibrator roller 94 where the dampening fluid is dissipated and absorbed, to such an extent as to be of no consequence in the inking system.

From the foregoing it should be readily apparent that the improved apparatus for applying liquid to lithographic printing systems offers control of metering at nip N to provide a film 104 of dampening fluid of precisely controlled thickness by adjusting pressure between transfer roller 10 and metering roller 12 and further by controlling surface speeds of the rollers relative to each other. The rate at which the metered film 104 of dampening fluid is offered to film 100 of ink, and also the hydraulic force for obtaining the desired film split while eliminating conditions which cause feedback of excessive quantities of ink with dampening fluid film 116 on transfer roller 10 moving away from the nip 106 is accomplished by the improved structure.

While a preferred embodiment of the invention has been hereinbefore described and illustrated in the attached drawings it should be appreciated that other and further forms of the apparatus can be devised without departing from the basic concept thereof.

For example, one or more redundant rollers might be incorporated in the system for further metering or transferring of films of dampening fluid or ink. It should further be appreciated that either the transfer roller 10 or metering roller 12 could be geared to the press drive, or driven by an independent drive means, for establishing the conditions hereinbefore described for a specified speed range.

However, provision of independently controllable variable speed drive motors 69 and 71 for controlling the speed of rotation of transfer roller 10 and metering roller 12 together with means for adjusting pressure between rollers 10 and 12 and between roller 10 and 90 produces superior results under variable operating conditions and at varying press speeds.

Having described my invention I claim:

1. A method of metering dampening fluid onto a moving film of ink comprising the steps of:

metering a film of dampening fluid between independently driven rollers positioned in pressure indented relation;

moving the film of dampening fluid into contact with a surface of the film of ink such that contacting surfaces of the film of ink and the film of dampening fluid move at different surface speeds;

maintaining the speed differential between the surface of the ink film and the film of dampening fluid to within a range wherein the film of dampening fluid is split, transferring a portion of the film of dampening fluid to the surface of the ink;

rotating the metering roller such that the surface speed thereof is less than the surface speed of the ink film.

2. A method of dampening a plate on a lithographic press comprising the steps of:

depositing a layer of dampening fluid on the surface of resilient metering roller;

rotating the layer of dampening fluid against the surface of a hard hydrophillic transfer roller in pressure indented relationship therewith;

metering a film of such dampening fluid from said layer between the surfaces of said rollers;

transporting the metered film to the surface of an ink coated roller; and controlling the relative speeds of rotation of the rollers such that there will be slippage therebetween.

3. The method called for in claim 2 wherein the relative speeds of rotation of the rollers is such that fluid will not be separated from the surfaces thereof by centrifugal force.

* * * * *